US011933581B1

(12) United States Patent
Levette

(10) Patent No.: US 11,933,581 B1
(45) Date of Patent: Mar. 19, 2024

(54) RIFLE STOCK WITH MAGNETIC PISTOL HOLDER

(71) Applicant: Richard Levette, Willow Grove, PA (US)

(72) Inventor: Richard Levette, Willow Grove, PA (US)

( * ) Notice: Subject to any disclaimer, the term of this patent is extended or adjusted under 35 U.S.C. 154(b) by 0 days.

(21) Appl. No.: 17/943,329

(22) Filed: Sep. 13, 2022

(51) Int. Cl.
*F41C 23/20* (2006.01)
*F41C 3/00* (2006.01)
*F41C 27/00* (2006.01)

(52) U.S. Cl.
CPC ..... *F41C 23/20* (2013.01); *F41C 3/00* (2013.01); *F41C 27/00* (2013.01)

(58) Field of Classification Search
CPC ..... F41C 23/23; F41C 3/00; F41C 27/00
See application file for complete search history.

(56) References Cited

U.S. PATENT DOCUMENTS 894,101 A * 7/1908 Balson ..... F41C 23/22 42/71.01
2,765,107 A * 10/1956 Browning ..... F41C 33/0245 224/912
2,910,804 A * 11/1959 White ..... F41C 33/041 D3/222
3,796,358 A * 3/1974 Grubb ..... F41A 17/02 224/912
D335,221 S 5/1993 Nichols
5,611,471 A * 3/1997 French ..... F41C 33/008 224/244
5,749,507 A * 5/1998 Wood ..... F41C 33/048 224/678
5,768,816 A * 6/1998 Rassias ..... F41A 17/44 42/70.11
6,267,279 B1 * 7/2001 Matthews ..... F41C 33/0236 224/245
7,540,107 B2 * 6/2009 Oum ..... F41C 23/22 42/71.01
8,141,758 B2 3/2012 Spielberger
8,403,278 B1 * 3/2013 Kasbohm ..... F41A 23/18 42/99
8,739,452 B1 * 6/2014 Calvert ..... F41G 11/004 42/106
8,752,742 B2 * 6/2014 Clark ..... F41C 33/0281 224/243
8,763,295 B2 * 7/2014 Trimble ..... F41A 23/02 42/72
8,789,306 B1 * 7/2014 Mazzoni ..... F41C 33/04 42/71.01
8,943,729 B2 2/2015 Williams
9,261,328 B2 * 2/2016 Sitz ..... F41C 33/0245
9,459,073 B1 * 10/2016 Kloeppel ..... F41C 23/22
9,494,278 B2 * 11/2016 Mantua ..... F16M 13/022
(Continued)

FOREIGN PATENT DOCUMENTS

WO 2018023076 2/2018

*Primary Examiner* — Michelle Clement
(74) *Attorney, Agent, or Firm* — Kyle A. Fletcher, Esq.

(57) ABSTRACT

The rifle stock with magnetic pistol holster structure incorporates a first firearm, a second firearm, and a holster structure. The holster structure secures the second firearm to the first firearm. The holster structure removably attaches to the first firearm. The holster structure magnetically attaches to the first firearm. The second firearm removably attaches to the holster structure.

12 Claims, 8 Drawing Sheets

(56) References Cited

U.S. PATENT DOCUMENTS

| | | | | |
|---|---|---|---|---|
| 9,726,450 | B2 * | 8/2017 | Borkowski | F41C 23/02 |
| 9,777,988 | B2 * | 10/2017 | Karcher | F41C 33/041 |
| 10,302,392 | B2 * | 5/2019 | Waters | F41C 33/0272 |
| 10,443,975 | B2 * | 10/2019 | Robertson | F41C 33/041 |
| 10,697,727 | B2 * | 6/2020 | Higgins | F41C 33/0209 |
| D956,167 | S * | 6/2022 | Xu | D22/108 |
| 11,609,065 | B2 * | 3/2023 | Raymond | F41C 23/04 |
| 11,619,464 | B2 * | 4/2023 | Cerda | B60R 7/14 248/205.3 |
| 11,641,936 | B2 * | 5/2023 | Phillips | F41C 33/06 211/64 |
| 2001/0019071 | A1 * | 9/2001 | Vor Keller | F41C 33/029 224/244 |
| 2008/0000131 | A1 * | 1/2008 | Oum | F41C 33/0227 42/71.01 |
| 2011/0225865 | A1 * | 9/2011 | Williams | F41C 23/16 42/90 |
| 2012/0255979 | A1 * | 10/2012 | Sitz | F41C 33/0245 42/90 |
| 2014/0224847 | A1 * | 8/2014 | Miller | F41C 33/04 224/183 |
| 2018/0135939 | A1 * | 5/2018 | Tedder | F41C 33/0209 |
| 2019/0072357 | A1 * | 3/2019 | Couie | A47B 81/005 |
| 2019/0154397 | A1 * | 5/2019 | Holloway, II | F41C 33/0263 |
| 2023/0122193 | A1 * | 4/2023 | Main | F41C 33/0263 224/243 |

* cited by examiner

RIFLE STOCK WITH MAGNETIC PISTOL HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessories for small arms including rifles and pistols. (F41C00/00)

SUMMARY OF INVENTION

The rifle stock with magnetic pistol holster structure comprises a first firearm, a second firearm, and a holster structure. The holster structure secures the second firearm to the first firearm. The holster structure removably attaches to the first firearm. The holster structure magnetically attaches to the first firearm. The second firearm removably attaches to the holster structure.

These together with additional objects, features and advantages of the rifle stock with magnetic pistol holster structure will be readily apparent to those of ordinary skill in the art upon reading the following detailed description of the presently preferred, but nonetheless illustrative, embodiments when taken in conjunction with the accompanying drawings.

In this respect, before explaining the current embodiments of the rifle stock with magnetic pistol holster structure in detail, it is to be understood that the rifle stock with magnetic pistol holster structure is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rifle stock with magnetic pistol holster structure.

It is therefore important that the claims be regarded as including such equivalent construction insofar as they do not depart from the spirit and scope of the rifle stock with magnetic pistol holster structure. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
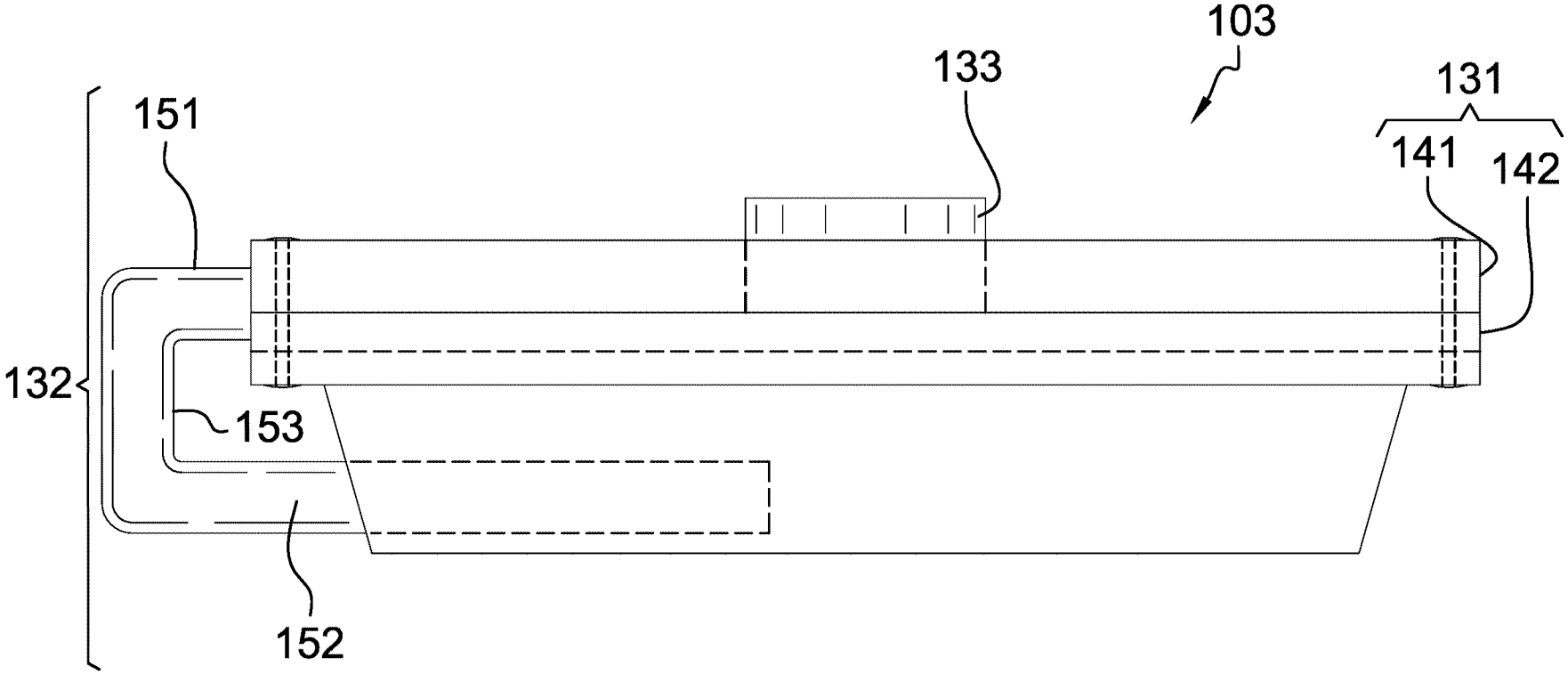
FIG. 1 is a side view of an embodiment of the disclosure.
Figure 3:
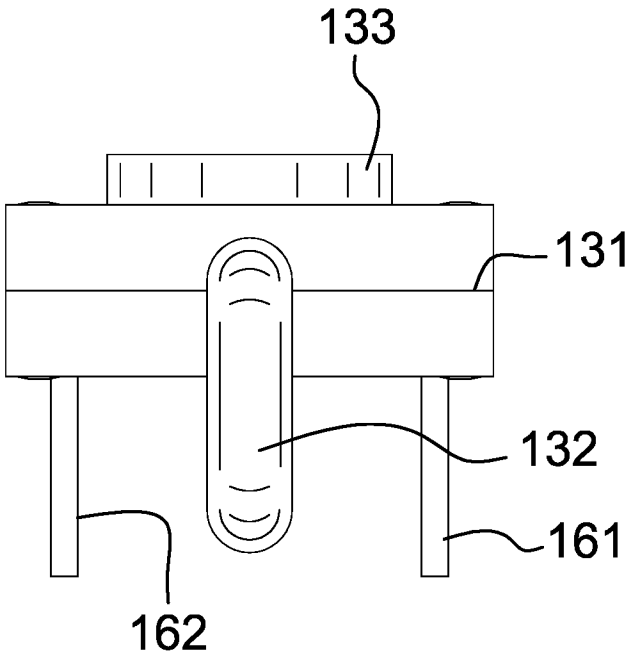
FIG. 3 is a rear view of an embodiment of the disclosure.
Figure 2:
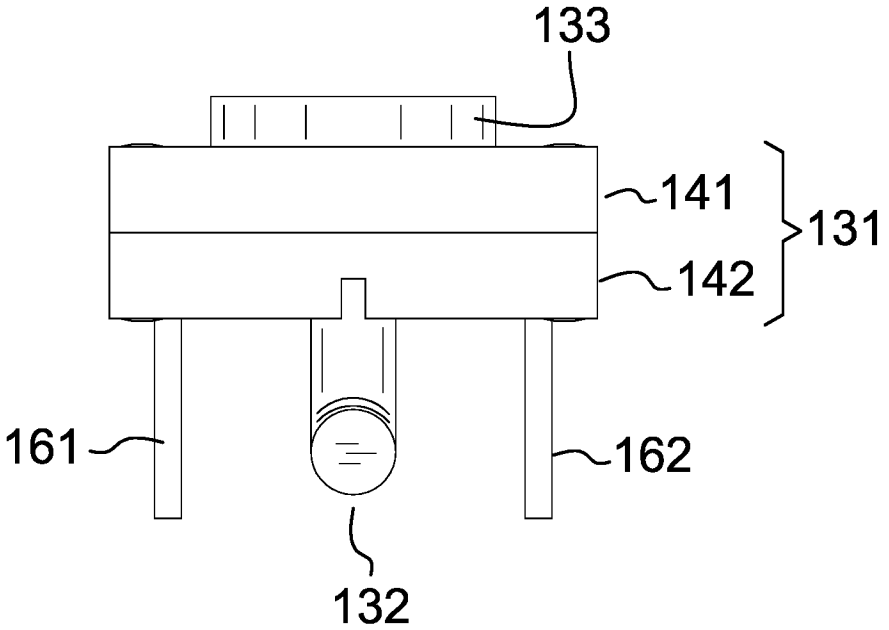
FIG. 2 is a front view of an embodiment of the disclosure.
Figure 4:
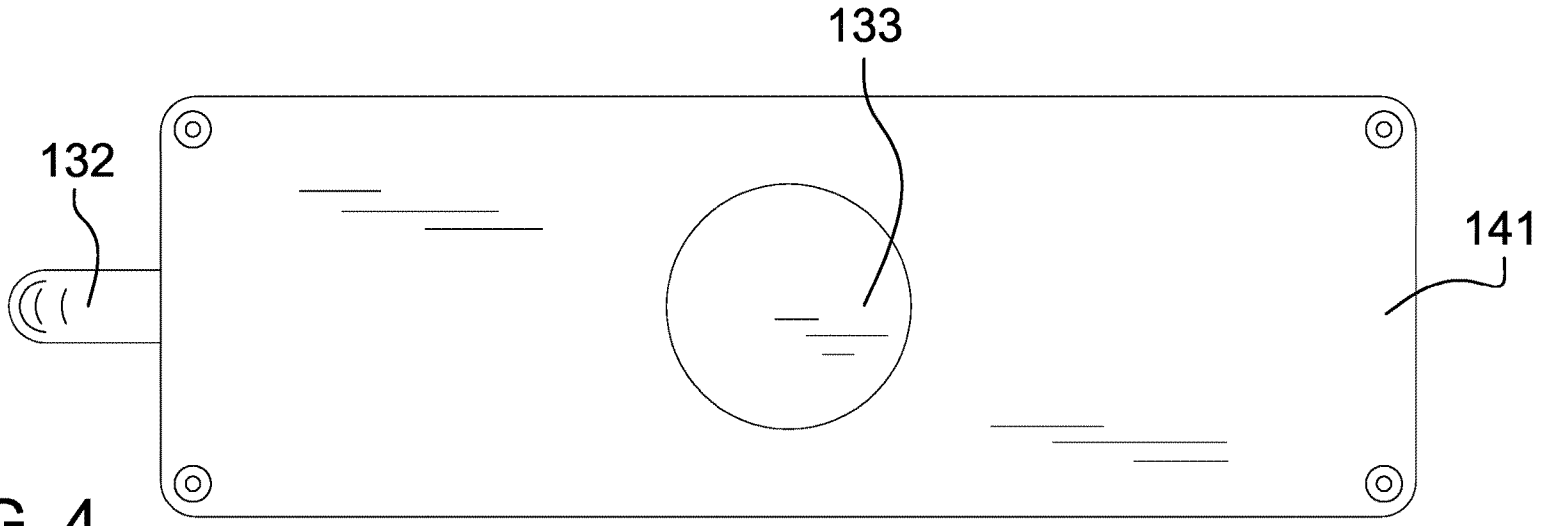
FIG. 4 is a top view of an embodiment of the disclosure.
Figure 5:
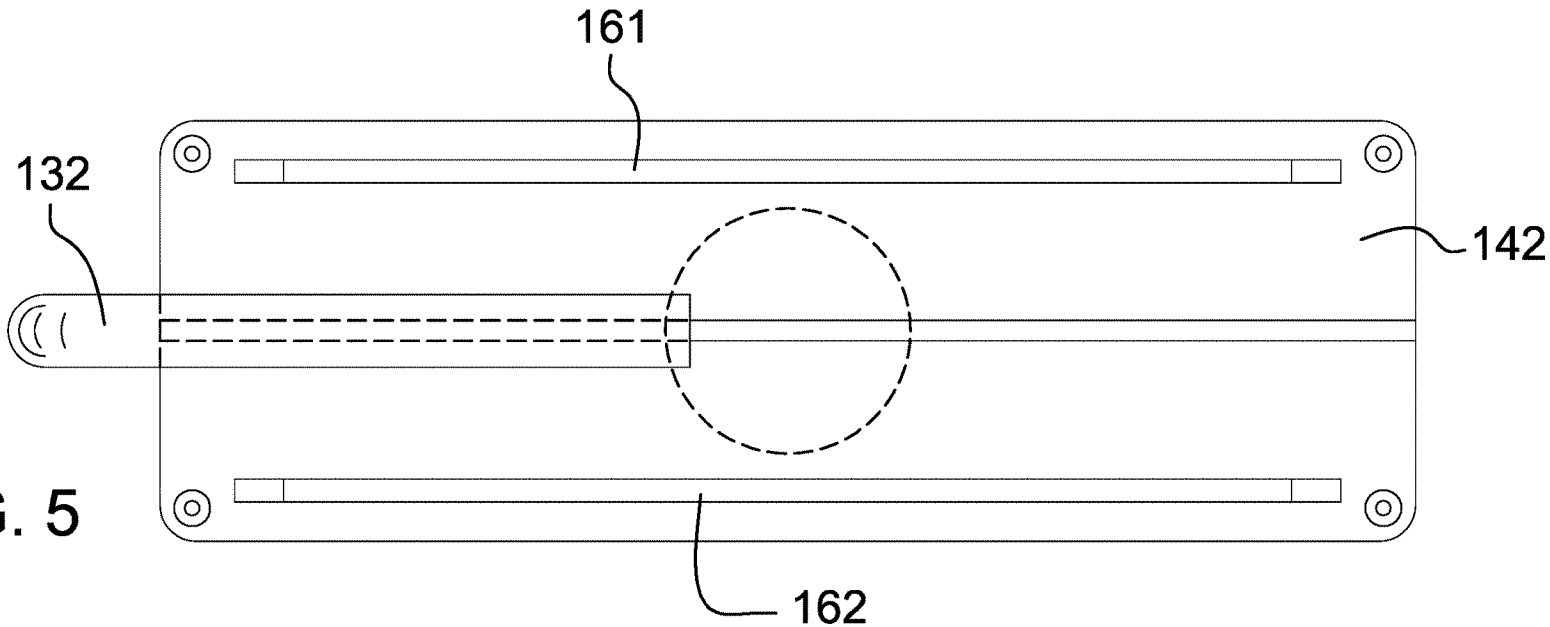
FIG. 5 is a bottom view of an embodiment of the disclosure.
Figure 6:
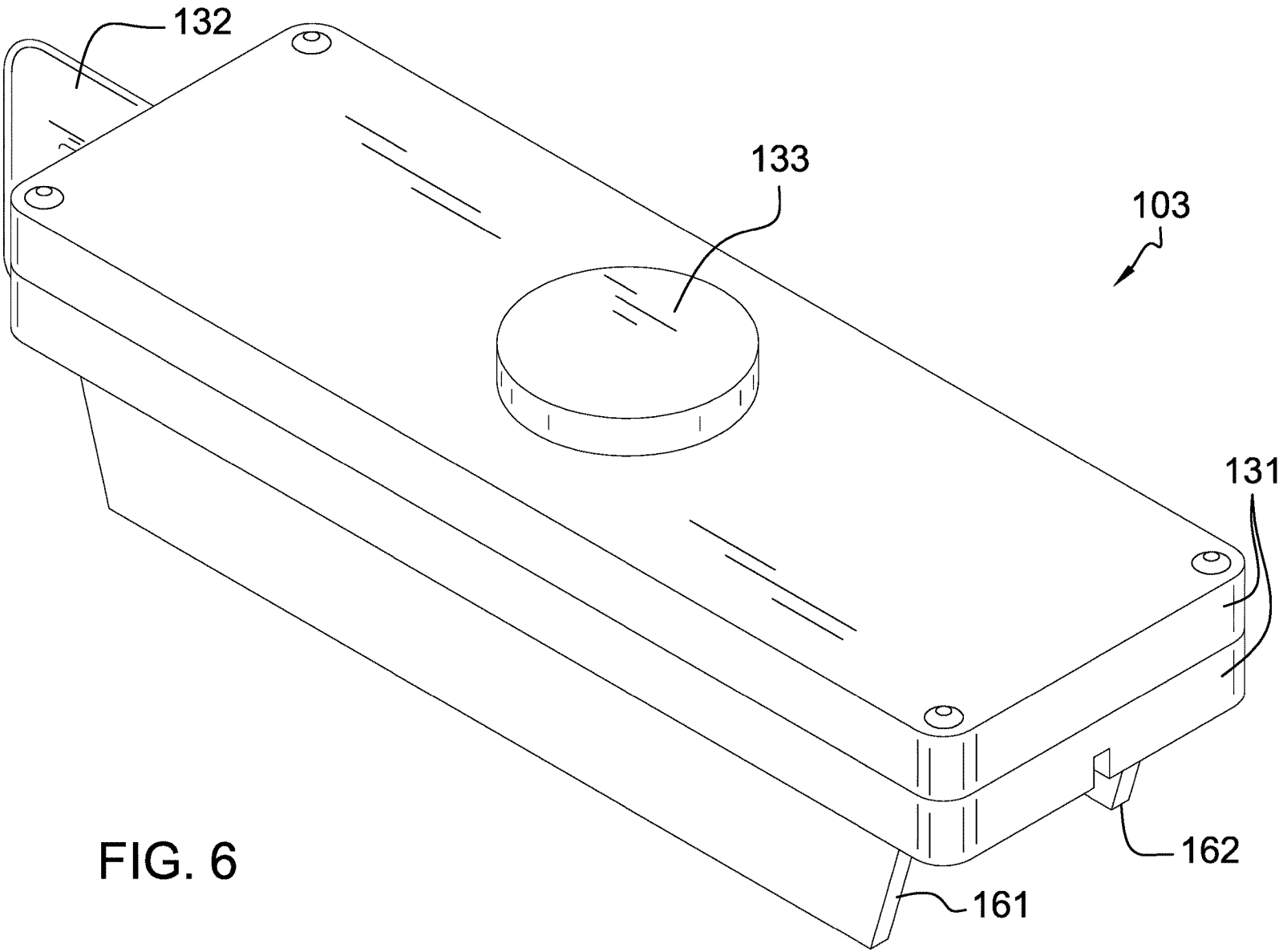
FIG. 6 is a perspective view of an embodiment of the disclosure.
Figure 7:
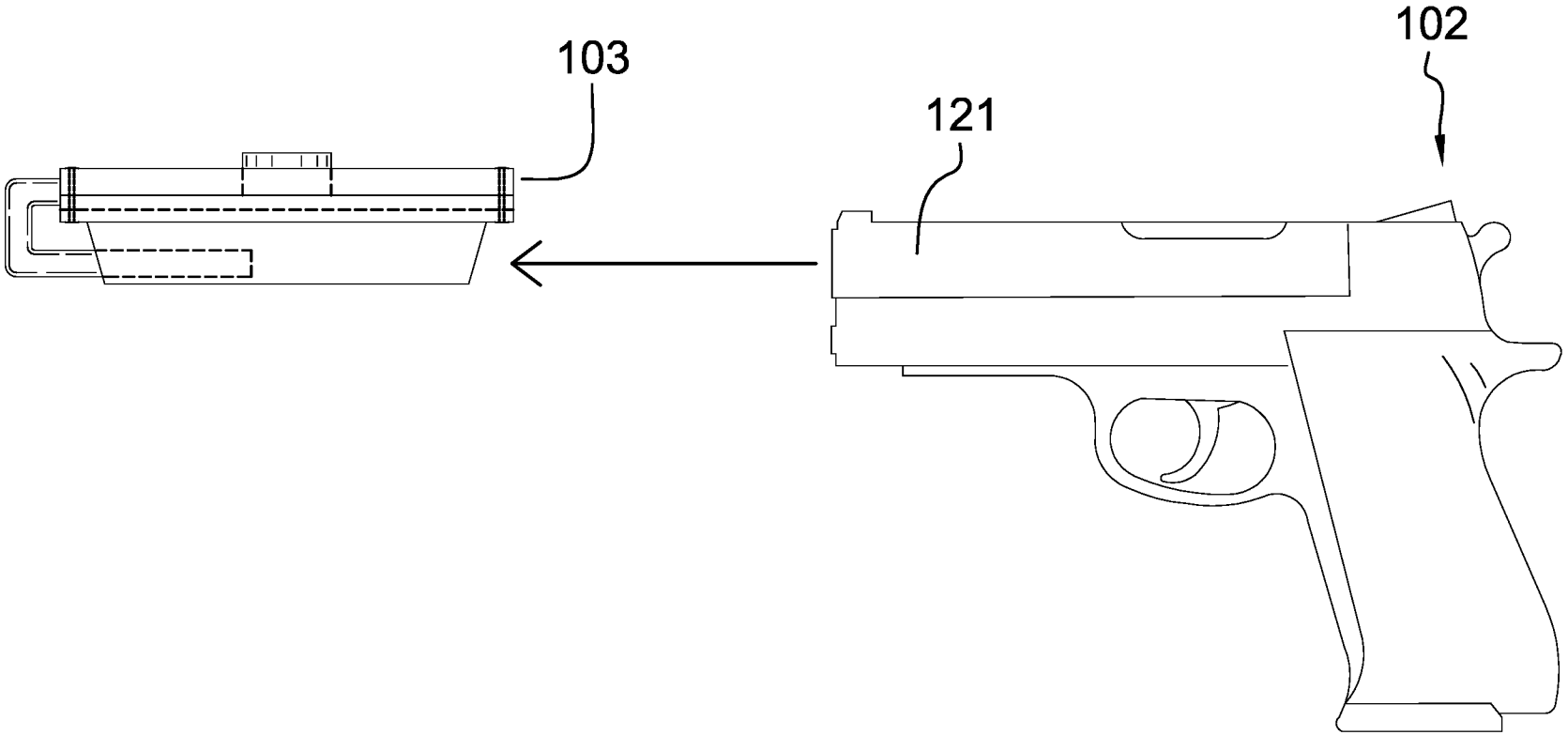
FIG. 7 is an exploded view of an embodiment of the disclosure.
Figure 8:
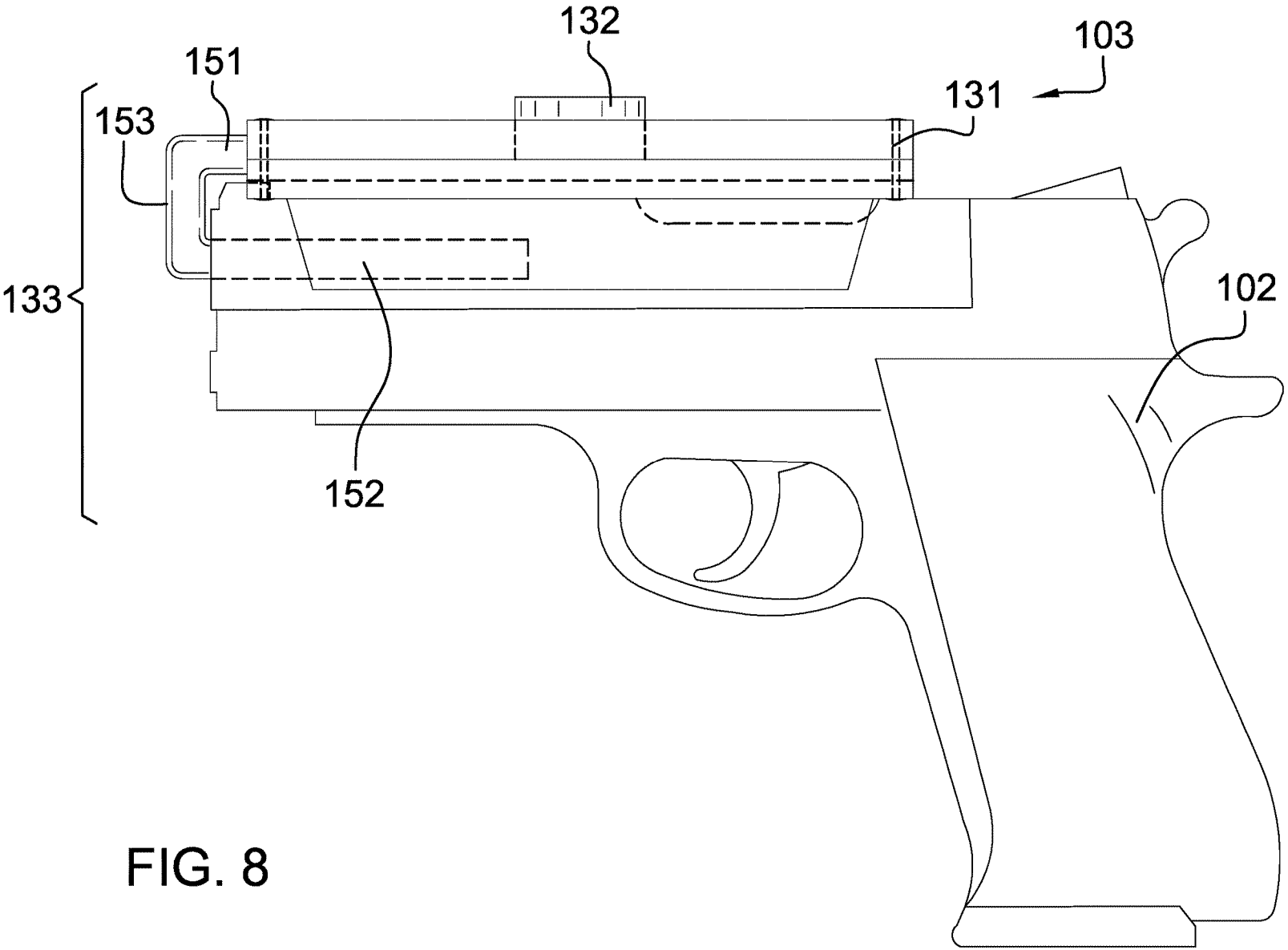
FIG. 8 is an in-use view of an embodiment of the disclosure.
Figure 9:
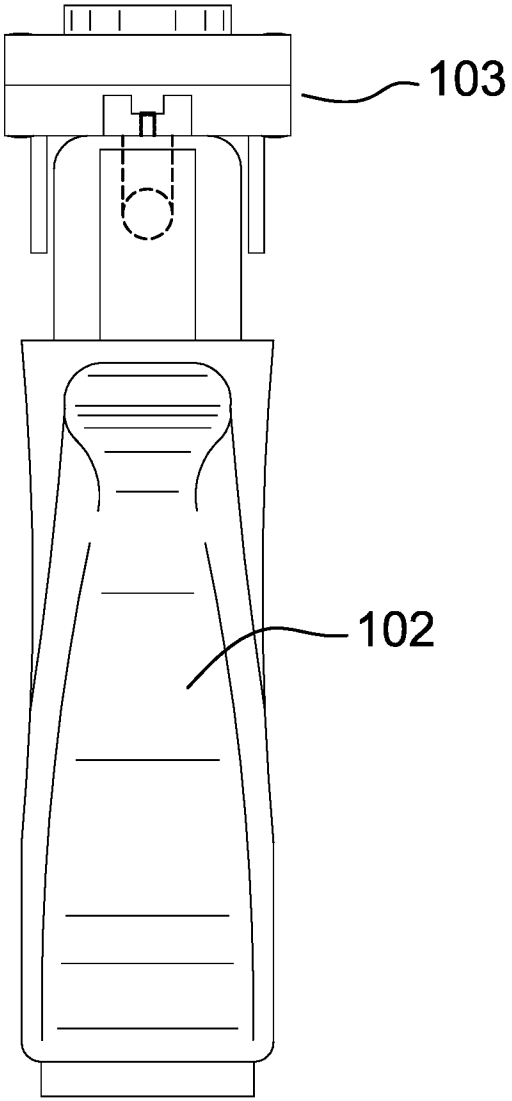
FIG. 9 is an in-use view of an embodiment of the disclosure.
Figure 10:
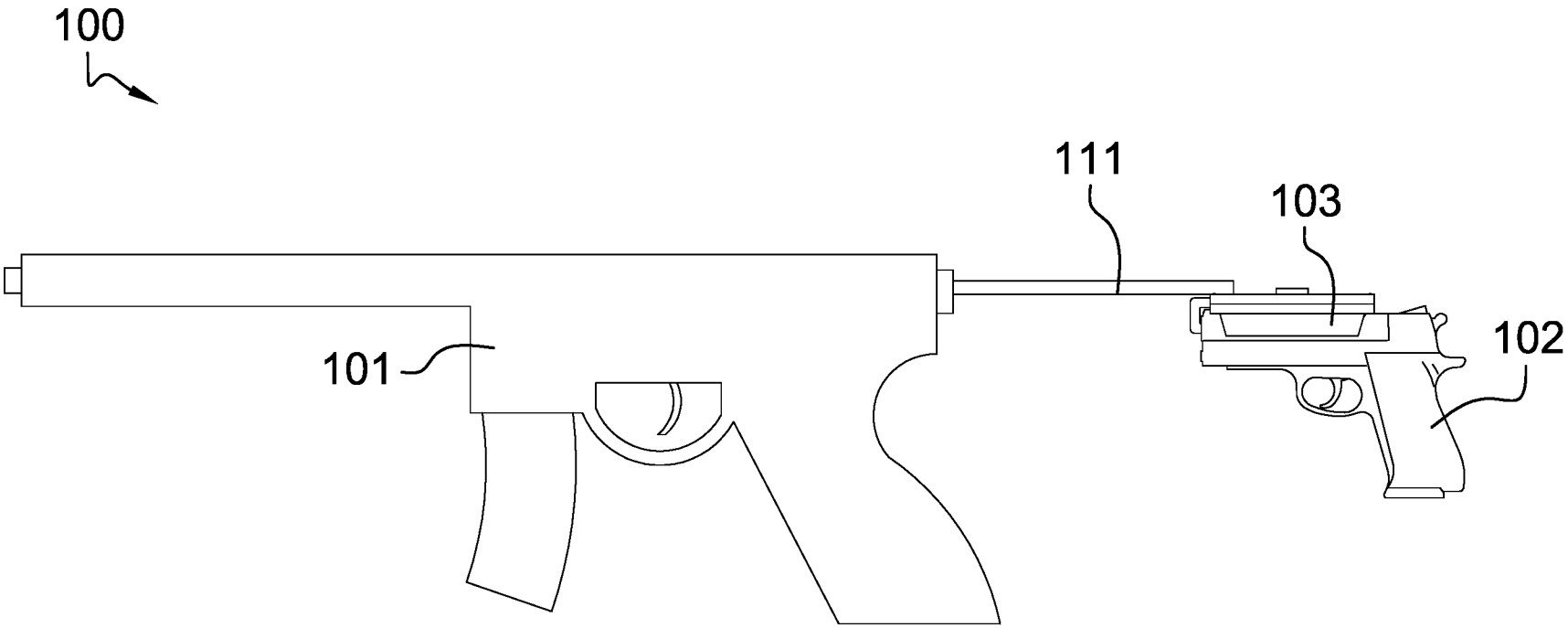
FIG. 10 is an in-use view of an embodiment of the disclosure.

Detailed reference will now be made to one or more potential embodiments of the disclosure, which are illustrated in FIGS. 1 through 10.

The rifle stock with magnetic pistol holster 100 (hereinafter invention) comprises a first firearm 101, a second firearm 102, and a holster structure 103. The holster structure 103 secures the second firearm 102 to the first firearm 101. The holster structure 103 removably attaches to the first firearm 101. The holster structure 103 magnetically attaches to the first firearm 101. The second firearm 102 removably attaches to the holster structure 103.

The first firearm 101 is a firearm known as a rifle. The firearm is defined elsewhere in this disclosure. The holster structure 103 removably attaches to the first firearm 101. The holster structure 103 removably secures the second firearm 102 to the first firearm 101. The first firearm 101 further comprises a buttstock 111. The buttstock 111 is a portion of the stock structure of the first firearm 101 that is distal from the barrel of the first firearm 101. The buttstock 111 is a rigid structure. The buttstock 111 is used to carry and operate the first firearm 101. The buttstock 111 is defined elsewhere in this disclosure.

The second firearm 102 is a firearm known as a pistol. The firearm is defined elsewhere in this disclosure. The second firearm 102 is detachably secured to the holster structure 103. The second firearm 102 further comprises a barrel 121. The barrel 121 is a prism shaped structure. The barrel 121 is a hollow structure. The barrel 121 guides the path of the projectile as the projectile is discharged from the second firearm 102. The barrel 121 is defined elsewhere in this disclosure.

The holster structure 103 is a mechanical apparatus. The holster structure 103 is a fastening device that secures the second firearm 102 to the first firearm 101. The holster structure 103 removably attaches to the first firearm 101. The holster structure 103 magnetically attaches to the buttstock 111 of the first firearm 101. The buttstock 111 is made of a ferrous material or is magnet so as to attach to the holster structure 103 of the invention. The invention 100 is using magnetism to secure itself to the buttstock 111. The holster structure 103 attaches to the second firearm 102 by inserting into the barrel 121 of the second firearm 102. The holster structure 103 comprises a barrel sleeve 131, a barrel plug 132, and a magnetic fastener 133.

The barrel sleeve 131 is a mechanical apparatus. The barrel sleeve 131 encloses the superior surfaces of the barrel 121 of the second firearm 102. The barrel sleeve 131 forms the physical structure that secures the holster structure 103 to the buttstock 111 of the first firearm 101. The barrel sleeve 131 forms a u-shaped structure. The barrel 121 inserts between the arms of the u-shaped structure formed by the barrel sleeve 131. The barrel sleeve 131 comprises a superior plate 141 and an inferior plate 142.

The superior plate 141 is a disk shaped structure. The superior plate 141 is a rigid structure. The inferior plate 142 is a disk shaped structure. The inferior plate 142 is a rigid structure. The inferior plate 142 is geometrically identical to the superior plate 141. A congruent end of the disk structure of the inferior plate 142 permanently attaches to a congruent end of the disk structure of the superior plate 141 to form a composite prism structure. The barrel plug 132 attaches to the composite prism structure formed by the inferior plate 142 and the superior plate 141. The magnetic fastener 133 attaches to the exterior congruent end of the disk structure of the superior plate 141. The inferior plate 142 further comprises a first side guard 161 and a second side guard 162.

The first side guard 161 is a disk shaped structure. The first side guard 161 is a rigid structure. The lateral face of the first side guard 161 attaches to the exterior congruent end of the disk structure of the inferior plate 142 such that the face of the disk structure first side guard 161 projects perpendicularly away from the exterior face of the inferior plate 142. The first side guard 161 projects away from the inferior plate 142 in the direction away from the superior plate 141.

The second side guard 162 is a disk shaped structure. The second side guard 162 is a rigid structure. The lateral face of the second side guard 162 attaches to the exterior congruent end of the disk structure of the inferior plate 142 such that the face of the disk structure second side guard 162 projects perpendicularly away from the exterior face of the inferior plate 142. The second side guard 162 projects away from the inferior plate 142 in the direction away from the superior plate 141.

The span of the perpendicular distance between the face of the disk structure of the second side guard 162 and the face of the disk structure of the first side guard 161 is selected such that the barrel 121 of the second firearm 102 fits between the second side guard 162 and the first side guard 161.

The barrel plug 132 is a mechanical structure. The barrel plug 132 suspends the second firearm 102 from the buttstock 111 of the first firearm 101. The barrel plug 132 attaches to the lateral face of the composite prism structure formed by the superior plate 141 and the inferior plate 142 of the first firearm 101. The barrel plug 132 attaches to the barrel sleeve 131 in the manner of a cantilever. The barrel plug 132 is a non-Euclidean prism structure. The barrel plug 132 is formed as an illiterate u-shaped structure. The free end of the barrel plug 132 removably inserts into the barrel 121 of the second firearm 102. The free end of the barrel plug 132 suspends the second firearm 102 from the buttstock 111 of the first firearm 101. The barrel plug 132 further comprises a first plug arm 151, a second plug arm 152, and a crossbeam 153.

The first plug arm 151 is a prism-shaped structure. The first plug arm 151 forms an arm of the u-shaped structure of the barrel plug 132. The first plug arm 151 attaches to the lateral face of the crossbeam 153 such that the center axis of the prism structure of the first plug arm 151 projects perpendicularly away from the center axis of the prism structure of the crossbeam 153.

The second plug arm 152 is a prism-shaped structure. The second plug arm 152 forms an arm of the u-shaped structure of the barrel plug 132. The second plug arm 152 attaches to the lateral face of the crossbeam 153 such that the center axis of the prism structure of the second plug arm 152 projects perpendicularly away from the center axis of the prism structure of the crossbeam 153. The second plug arm 152 attaches to the crossbeam 153 such that the center axis of the prism structure of the second plug arm 152 is parallel to the center axis of the prism structure of the first plug arm 151. The second plug arm 152 attaches to the crossbeam 153 such that the second plug arm 152 projects away from the crossbeam 153 in the same direction as the first plug arm 151. The second plug arm 152 attaches to the lateral face of the crossbeam 153 at the congruent end of the crossbeam 153 that is distal from the first plug arm 151. The surface area of the lateral face of the prism structure of the second plug arm 152 is greater than the surface area of the lateral face of the prism structure of the first plug arm 151 to form the illiterate barrel plug 132 of the barrel plug 132.

The crossbeam 153 is a prism-shaped structure. The crossbeam 153 forms the crossbeam 153 that is characteristic of a u-shaped structure. The crossbeam 153 attaches to the congruent end of the first plug arm 151 such that the center axis of the prism structure of the crossbeam 153 projects perpendicularly away from the center axis of the prism structure of the first plug arm 151. The crossbeam 153 attaches to the congruent end of the second plug arm 152 such that the face of the prism structure of the crossbeam 153 projects perpendicularly away from the center axis of the prism structure of the second plug arm 152. The second plug arm 152 attaches to the congruent end of the prism structure of the crossbeam 153 that is distal from the first plug arm 151.

The free end of the first plug arm 151 attaches to the lateral face of the composite prism structure formed by the superior plate 141 and the inferior plate 142. The free end of the second plug arm 152 is geometrically similar to the barrel 121 of the second firearm 102 such that the free end of the second plug arm 152 inserts into the barrel 121.

The magnetic fastener 133 is a permanent magnet. The magnetic fastener 133 permanently attaches to the face of the disk structure of the superior plate 141. The magnetic fastener 133 magnetically attaches to the composite prism structure formed by the superior plate 141 and the inferior plate 142. The magnetic fastener 133 removably attaches the barrel plug 132 to the barrel sleeve 131.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

Firearm: As used in this disclosure, a firearm is a handheld weapon designed to expel a projectile which has been accelerated using a mechanism comprising an explosion or an explosive decompression (referred to in this definition as explosive decompression. The combination of the projectile and the chemical compound required to generate the explosive decompression is called the ammunition. The primary components of a firearm comprises a barrel, a firing mechanism, a trigger, and a stock structure. The barrel is a tubular structure that guides the projectile out of the firearm after the explosive decompression has occurred. The firing mechanism: a) stores ammunition; b) loads the ammunition into the firing mechanism; c) initiates the explosive decompression that accelerates the projectile out of the barrel; and, d) discharges unnecessary components from the firearm after the explosive decompression. The trigger is a lever that initiates the explosive decompression within the firing mechanism. A safety refers to a mechanical mechanism that prevents the operation of the trigger. The stock forms the structure on which the barrel, firing mechanism, and the trigger mount. On larger handheld firearms (commonly called rifles), the stock further comprises a forestock and a buttstock. On smaller handheld firearms (commonly called pistols) the stock is commonly called the grip.

Fixed and Free End: As used in this disclosure, a fixed end refers to the congruent end of a first prism shaped structure that is secured to an anchor point of a primary structure. A free end refers to the congruent end of the first prism shaped structure: a) that is distal from the fixed end; and, b) that is not secured to the primary structure. The free end of the sheeting structure can be secured to a secondary structure that is independent of the primary structure.

Force of Gravity: As used in this disclosure, the force of gravity refers to a vector that indicates the direction of the pull of gravity on an object at or near the surface of the earth.

Forestock: As used in this disclosure, the forestock is the part of a rifle that supports the barrel of the rifle. A forestock may also refer to the portion of other types of small arms that similarly located. Forestocks are often fitted with a finger rest. The finger rest is a groove formed in the forestock that provides a grip point for use by the fingers.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Holster: As used in this disclosure, a holster is a storage structure that attaches to an object such as a belt, a webbing, a sling, or a luggage item. The holster is dedicated to containing a previously identified object such that the previously identified object is readily accessible.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole).

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

Negative Space: As used in this disclosure, negative space is a method of defining an object through the use of open or empty space as the definition of the object itself, or, through the use of open or empty space to describe the boundaries of an object.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force. See bimodal flexible structure.

Roughly: As used in this disclosure, roughly refers to a comparison between two objects. Roughly means that the difference between one or more parameters of the two compared objects are not significantly different.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rifle stock with magnetic pistol holster comprising
a first firearm, a second firearm, and a holster structure;
wherein the holster structure secures the second firearm to the first firearm;
wherein the holster structure attaches to the second firearm by inserting into the barrel of the second firearm;
wherein the holster structure comprises a barrel sleeve, a barrel plug, and a magnetic fastener;
wherein the barrel sleeve is a mechanical apparatus;
wherein the barrel sleeve encloses the superior surfaces of the barrel of the second firearm;
wherein the barrel sleeve forms the physical structure that secures the holster structure to the buttstock of the first firearm;
wherein the barrel sleeve forms a u-shaped structure;
wherein the barrel inserts between the arms of the u-shaped structure formed by the barrel sleeve.

2. The rifle stock with magnetic pistol holster according to claim 1
wherein the holster structure removably attaches to the first firearm;
wherein the holster structure magnetically attaches to the first firearm;
wherein the second firearm removably attaches to the holster structure.

3. The rifle stock with magnetic pistol holster according to claim 2
wherein the first firearm is a firearm known as a rifle;

wherein the first firearm further comprises a buttstock;
wherein the buttstock is a portion of the stock structure of the first firearm that is distal from the barrel of the first firearm;
wherein the buttstock is a rigid structure;
wherein the second firearm is a firearm known as a pistol;
wherein the second firearm further comprises a barrel;
wherein the barrel is a prism shaped structure;
wherein the barrel is a hollow structure.

4. The rifle stock with magnetic pistol holster according to claim 3
wherein the holster structure is a mechanical apparatus;
wherein the holster structure magnetically attaches to the buttstock of the first firearm.

5. The rifle stock with magnetic pistol holster according to claim 4
wherein the barrel sleeve comprises a superior plate and an inferior plate;
wherein the superior plate is a disk shaped structure;
wherein the superior plate is a rigid structure;
wherein the inferior plate is a disk shaped structure;
wherein the inferior plate is a rigid structure;
wherein the inferior plate is geometrically identical to the superior plate.

6. The rifle stock with magnetic pistol holster according to claim 5
wherein a congruent end of the disk structure of the inferior plate permanently attaches to a congruent end of the disk structure of the superior plate to form a composite prism structure;
wherein the barrel plug attaches to the composite prism structure formed by the inferior plate and the superior plate;
wherein the magnetic fastener attaches to the exterior congruent end of the disk structure of the superior plate.

7. The rifle stock with magnetic pistol holster according to claim 6
wherein the inferior plate further comprises a first side guard and a second side guard;
wherein the first side guard is a disk shaped structure;
wherein the first side guard is a rigid structure;
wherein the second side guard is a disk shaped structure;
wherein the second side guard is a rigid structure.

8. The rifle stock with magnetic pistol holster according to claim 7
wherein the lateral face of the first side guard attaches to the exterior congruent end of the disk structure of the inferior plate such that the face of the disk structure first side guard projects perpendicularly away from the exterior face of the inferior plate;
wherein the first side guard projects away from the inferior plate in the direction away from the superior plate;
wherein the lateral face of the second side guard attaches to the exterior congruent end of the disk structure of the inferior plate such that the face of the disk structure second side guard projects perpendicularly away from the exterior face of the inferior plate;
wherein the second side guard projects away from the inferior plate in the direction away from the superior plate.

9. The rifle stock with magnetic pistol holster according to claim 8 wherein the span of the perpendicular distance between the face of the disk structure of the second side guard and the face of the disk structure of the first side guard is selected such that the barrel of the second firearm fits between the second side guard and the first side guard.

10. The rifle stock with magnetic pistol holster according to claim 9
wherein the barrel plug is a mechanical structure;
wherein the barrel plug suspends the second firearm from the buttstock of the first firearm;
wherein the barrel plug attaches to the lateral face of the composite prism structure formed by the superior plate and the inferior plate of the first firearm;
wherein the barrel plug attaches to the barrel sleeve in the manner of a cantilever;
wherein the barrel plug is a non-Euclidean prism structure;
wherein the barrel plug is formed as an illiterate u-shaped structure;
wherein the free end of the barrel plug removably inserts into the barrel of the second firearm;
wherein the free end of the barrel plug suspends the second firearm from the buttstock of the first firearm.

11. The rifle stock with magnetic pistol holster according to claim 10
wherein the barrel plug further comprises a first plug arm, a second plug arm, and a crossbeam;
wherein the first plug arm is a prism-shaped structure;
wherein the first plug arm forms an arm of the u-shaped structure of the barrel plug;
wherein the first plug arm attaches to the lateral face of the crossbeam such that the center axis of the prism structure of the first plug arm projects perpendicularly away from the center axis of the prism structure of the crossbeam;
wherein the second plug arm is a prism-shaped structure;
wherein the second plug arm forms an arm of the u-shaped structure of the barrel plug;
wherein the second plug arm attaches to the lateral face of the crossbeam such that the center axis of the prism structure of the second plug arm projects perpendicularly away from the center axis of the prism structure of the crossbeam;
wherein the second plug arm attaches to the crossbeam such that the center axis of the prism structure of the second plug arm is parallel to the center axis of the prism structure of the first plug arm;
wherein the second plug arm attaches to the crossbeam such that the second plug arm projects away from the crossbeam in the same direction as the first plug arm;
wherein the second plug arm attaches to the lateral face of the crossbeam at the congruent end of the crossbeam that is distal from the first plug arm;
wherein the surface area of the lateral face of the prism structure of the second plug arm is greater than the surface area of the lateral face of the prism structure of the first plug arm to form the illiterate barrel plug of the barrel plug;
wherein the crossbeam is a prism-shaped structure;
wherein the crossbeam forms the crossbeam that is characteristic of a u-shaped structure;
wherein the crossbeam attaches to the congruent end of the first plug arm such that the center axis of the prism structure of the crossbeam projects perpendicularly away from the center axis of the prism structure of the first plug arm;
wherein the crossbeam attaches to the congruent end of the second plug arm such that the face of the prism structure of the crossbeam projects perpendicularly away from the center axis of the prism structure of the second plug arm;

wherein the second plug arm attaches to the congruent end of the prism structure of the crossbeam that is distal from the first plug arm;

wherein the free end of the first plug arm attaches to the lateral face of the composite prism structure formed by the superior plate and the inferior plate;

wherein the free end of the second plug arm is geometrically similar to the barrel of the second firearm such that the free end of the second plug arm inserts into the barrel.

12. The rifle stock with magnetic pistol holster according to claim 11 wherein the magnetic fastener is a permanent magnet;

wherein the magnetic fastener permanently attaches to the face of the disk structure of the superior plate;

wherein the magnetic fastener magnetically attaches to the composite prism structure formed by the superior plate and the inferior plate;

wherein the magnetic fastener removably attaches the barrel plug to the barrel sleeve.

* * * * *